United States Patent [19]

York

[11] 4,133,374

[45] Jan. 9, 1979

[54] HEAT EXCHANGER

[75] Inventor: James A. York, Glendale, Calif.

[73] Assignee: Smith Engineering Company, South El Monte, Calif.

[21] Appl. No.: 746,695

[22] Filed: Dec. 2, 1976

[51] Int. Cl.[2] ..... F28F 5/00

[52] U.S. Cl. ..... 165/82; 165/122; 110/304

[58] Field of Search ..... 165/81-83, 165/142-145; 110/56, 304; 122/356; 237/12-13 A

[56] References Cited

U.S. PATENT DOCUMENTS

| | | | |
|---|---|---|---|
| 1,796,945 | 3/1931 | Harter | 165/82 |
| 2,965,358 | 12/1960 | Behrens et al. | 165/82 |
| 3,121,559 | 2/1964 | Tippman | 165/83 |
| 3,973,621 | 8/1976 | Bow et al. | 165/83 |

*Primary Examiner*—Charles J. Myhre
*Assistant Examiner*—Theophil W. Streule, Jr.
*Attorney, Agent, or Firm*—Blakely, Sokoloff, Taylor & Zafman

[57] ABSTRACT

A heat exchanger which includes a plurality of elongated, parallel, vertical tubes for directing a hot fluid through a cross flowing fluid, particularly suited for handling larger quantities of fluid which contains abrasives. Each of the continuous tubes are secured at opposite ends to tube sheets. One tube sheet provides vertical support for the tubes, the other tube sheet is allowed to float. The tubes are thus unrestrained in the vertical direction and are permitted to freely expand in the presence of the hot fluid.

3 Claims, 12 Drawing Figures

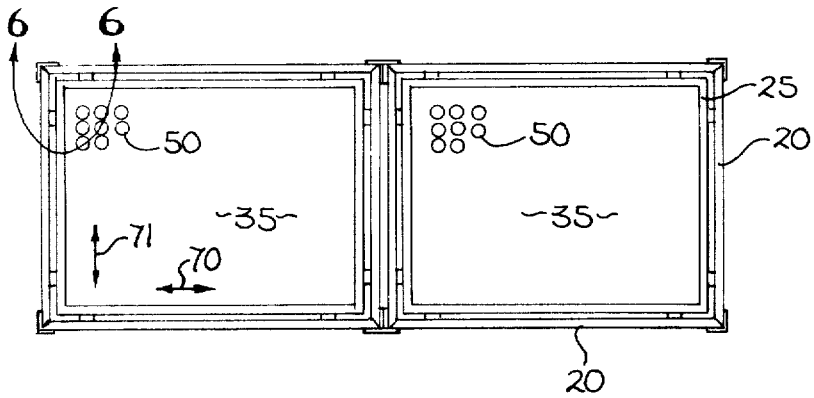
Fig. 3
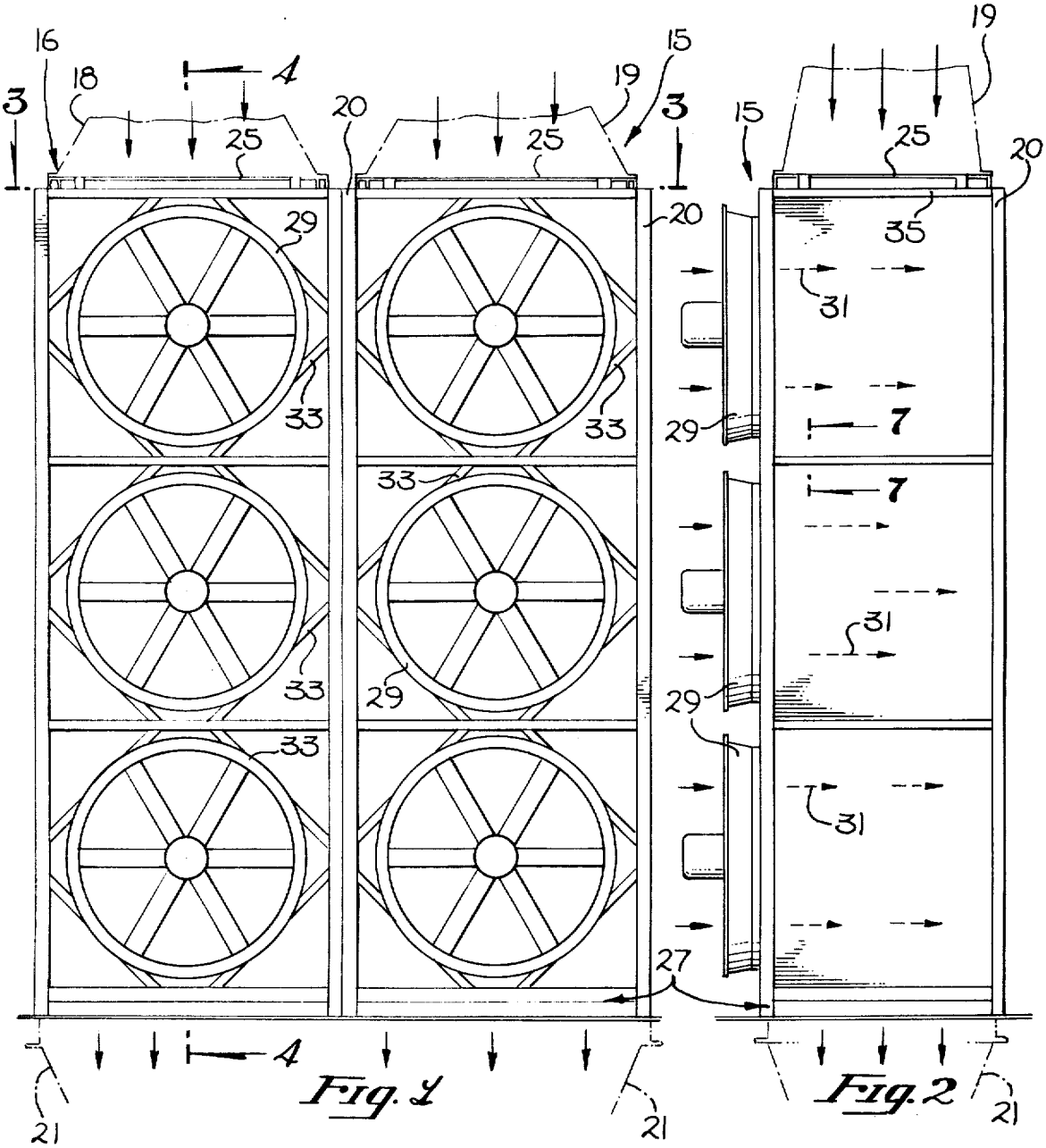
Fig. 1
Fig. 2

HEAT EXCHANGER

BACKGROUND OF THE INVENTION

1. Field of the Invention

The invention relates to the field of fluid heat exchangers.

2. Prior Art

Recent environmental concerns have required the development of new technologies aimed at preventing the deterioration of our atmosphere. One area which has received considerable attention is the discharge into the atmosphere of gasses that result from the burning of fossil fuels. In the case of utilities, this requires equipment to handle very large quantities of fluids such as the flue gasses from furnaces.

Flue gasses, as well as other fluids, often require cooling before they can be effectively and efficiently filtered. This cooling may also be part of a heat recovery system used to conserve energy by recovering heat from the flue gasses. The flue gasses are typically passed through large bag filters which filters remove particulates such as ash. These filters operate more effectively if the gasses are cooled, thus a requirement exists for heat exchangers capable of handling large quantities of hot fluids which contain abrasives.

Prior art heat exchangers cannot be readily expanded in size to handle the large volume of gas required in this application. Moreover, the abrasive contaminants contained in the flue gasses cause considerable wear in some prior art heat exchanger, while in other prior art exchangers contaminants accumulate resulting in a reduction in handling capacity and efficiency.

As will be seen the invented heat exchanger is suitable for handling large quantities of hot fluids including fluids which contain abrasive contaminants.

SUMMARY OF THE INVENTION

A heat exchanger is described which includes a plurality of elongated, generally parallel, continuous tubes. The lower ends or outlet ends of these tubes are rigidly secured to a platform, which platform provides vertical support for the tubes. The upper ends of the tubes are coupled to a bulkhead which bulkhead floats within the heat exchanger frame, that is, the bulkhead is free to move in the vertical direction. The bulkhead is coupled between an inlet transition member and the upper ends of the tubes. Spacer sheets are disposed within the heat exchanger frame to assure that the elongated tubes remain uniformly spaced. The tubes freely pass through apertures in these sheets, thus allowing the tubes to freely expand. Fans are mounted on the heat exchanger frame to provide a cross flow through the tubes.

The continuous, straight tubes do not significantly wear from an abrasive fluid nor do they provide surfaces where contaminants are likely to accumulate. Moreover, these tubes may be readily cleaned. The floating bulkhead along with the spacer sheets allow these long tubes to be used without problems which would otherwise result from the expansion of the tubes.

BRIEF DESCRIPTION OF THE DRAWINGS

FIG. 1 is a front view illustrating two sections of the presently preferred embodiment of the invented heat exchanger.

FIG. 2 is a side view of the heat exchanger of FIG. 1.

FIG. 3 is a cross-sectional plan view of the two sections of the heat exchanger taken through section line 3—3 of FIG. 1.

DETAILED DESCRIPTION OF THE INVENTION

Figure 4:
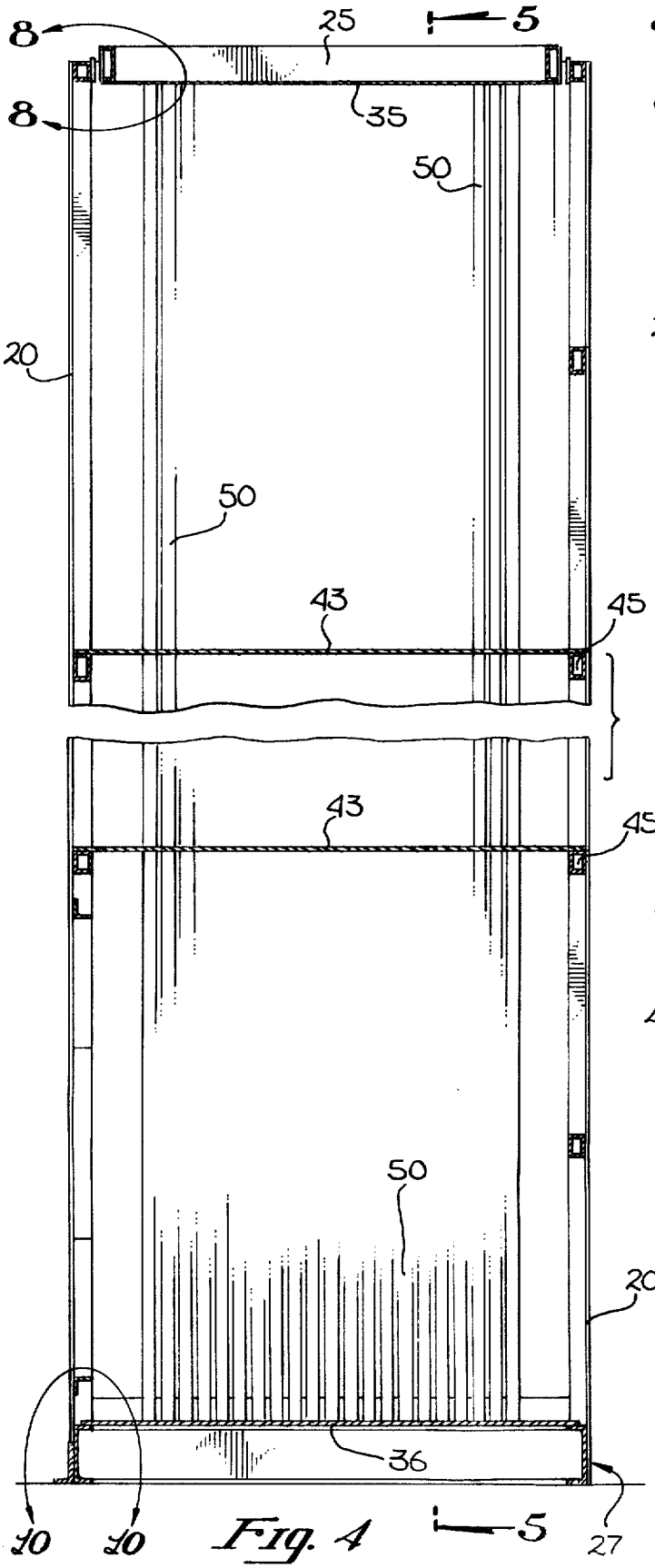
FIG. 4 is a cross-sectional side view of the heat exchanger taken through section line 4—4 of FIG. 1.

A heat exchanger is described which is particularly suitable for cooling large quantities of fluid such as hot flue gas, particularly where the fluid contains abrasive contaminants. In the following description, numerous specific details such as the length of the tubes, inlet temperatures, etc., are given in order to provide a complete understanding of the inventive concepts. However, it will be obvious to one skilled in the art that these inventive concepts may be employed without use of the specific details provided in the following specification.

The heat exchanger described in this application is capable of handling fluids such as flue gasses with an inlet temperature to the heat exchanger as high as 1800° F. Each section of the heat exchanger (two such sections are shown in FIG. 1) is capable of handling approximately 50,000 SCFM.

Referring first to FIGS. 1 and 2, a section 15 and a section 16 of the heat exchanger are shown. The inlet fluid to section 15, that is, by way of example, the exhaust from a furnace, is coupled to the heat exchanger through an inlet transition member 18. An inlet transition member 19 couples the inlet fluid into section 15 of the heat exchanger. The outlet fluid from the heat exchanger sections 15 and 16 is coupled into a single outlet transition member 21 as shown in FIGS. 1 and 2. The inlet fluid as it enters the heat exchanger is directed into a plurality of elongated tubes 50 shown best in FIGS. 4 and 5. A cross flowing fluid such as air is forced transversely past these tubes as indicated by flow lines 31 of FIG. 2 to remove heat from the tubes.

In the presently preferred embodiment, each of the tubes 50 are continuous, straight, steel tubes. Since the tubes are continuous, wear within the tubes from the contaminants carried by the fluids is reduced. Moreover, since the tubes are continuous and straight there is less likelihood that a buildup of contaminants within the tube will occur. However, with this configuration the tubes may be readily cleaned with a cleaning device which passes from one end of the tubes to the other. While these tubes provide numerous advantages one problem in employing them is the fact that they expand in the presence of the hot inlet fluid, thus means must be provided to compensate for this expansion. By way of example, in the presently preferred embodiment, these tubes are each 50 to 60 feet in length. With an inlet temperature of approximately 1500° F., each of these tubes may expand as much as 5 to 6 inches.

The major components of the heat exchanger include a frame 20 which frame provides structural support, particularly support for the fans 29 (FIGS. 1 and 2). As will be seen, the frame 20 is fixed and since the frame is not in contact with the hot inlet fluid, little expansion occurs in the frame. The vertical tubes 50 of the heat exchanger are supported by support platform 27 shown in FIGS. 4 and 5. The support platform which is coupled to the lower ends of the tubes 50 interconnects the lower end of the tubes with the outlet transition member. The plurality of the elongated, vertical, continuous tubes 50 have their upper ends connected to an inlet bulkhead 25. This bulkhead which is best seen in FIGS. 1, 2, 3, 4, 5, 8 and 9, floats within the upper end of the frame 20 on the upper ends of the tubes 50. The bulkhead interconnects the upper ends of the tubes with the inlet transition member. A plurality of spacer sheets 43 (FIGS. 4, 5 and 7) are disposed between the upper end and lower end of the heat exchanger and provide lateral support for the tubes 50 in addition to providing rigidity to the frame 20.

Figure 5:
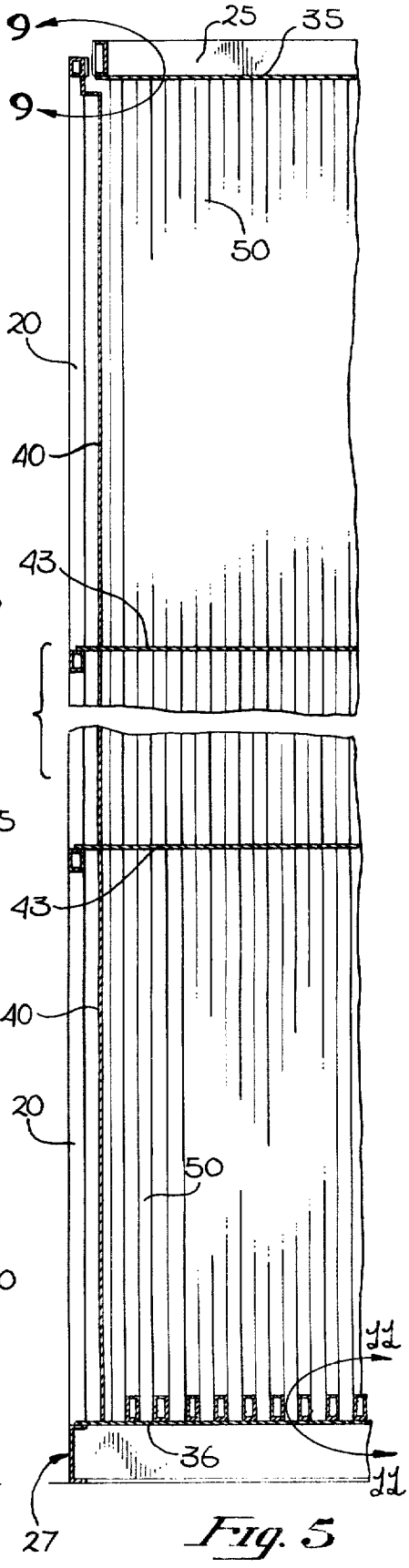
FIG. 5 is a partial cross-sectional front view of the heat exchanger taken through section line 5—5 of FIG. 4.
Figure 7:
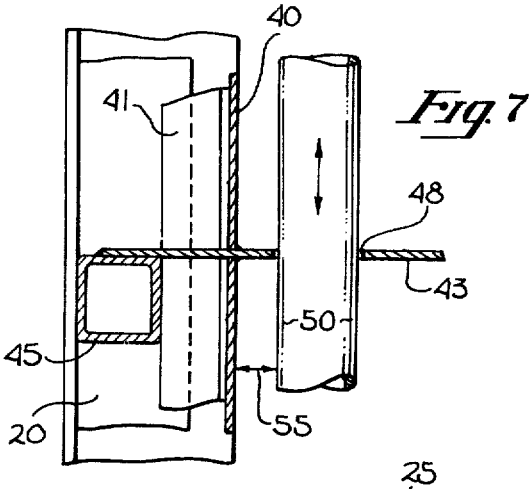
FIG. 7 is a partial cross-sectional frontal view of the heat exchanger used to illustrate one of the spacer sheets, this view is taken through section line 7—7 of FIG. 2.
Figure 9:
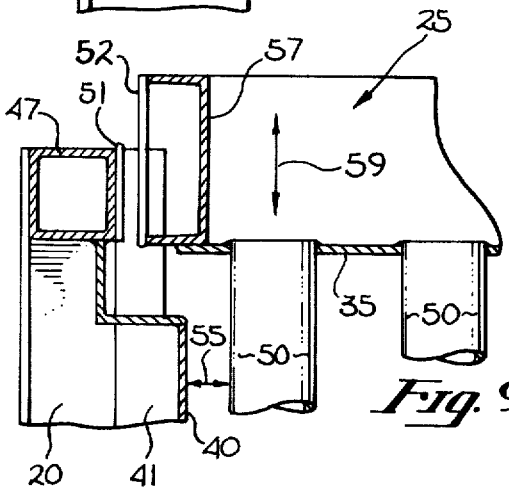
FIG. 9 is an exploded cross-sectional front view, again illustrating the upper end of the heat exchanger frame and the inlet bulkhead taken through section line 9—9 of FIG. 5.
Figure 10:
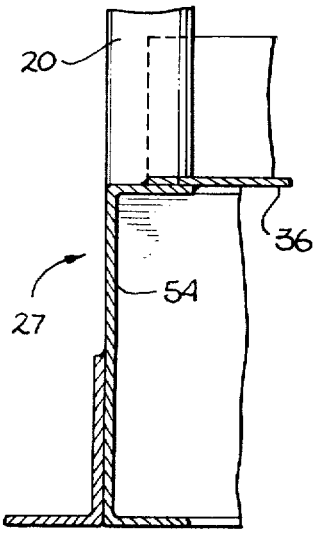
FIG. 10 is an exploded cross-sectional side view of the edge of the support platform, which platform supports the tubes in the heat exchanger. This view is taken through section line 10—10 -f FIG. 4.

In general the frame 20 is a rectilinear frame fabricated from steel members which are supported from the platform 27 as is best seen in FIGS. 4, 5 and 10. The frame includes a plurality of cross members 33 (FIG. 1) which support the fans 29. These fans as is best seen in FIG. 2 provide the cross flow 31 which flow removes the heat from the tubes 50. A vertical baffle plate 40 shown in FIGS. 7 and 9 is disposed along the sides of each section of the heat exchanger. This baffle in addition to providing rigidity to the frame restricts the cross flow such that the cross flow remains substantially between the tubes. An elongated vertical spacer 41 (FIGS. 7 and 9) is provided adjacent to the baffle 40 at opposite ends of the frame to enhance the cross flow. In the presently preferred embodiment the baffle plate 40 is spaced apart from the first column of tubes 50 by a distance equal to the radius of tube 50. This distance is shown as dimension 55 in FIGS. 7 and 9.

Figure 6:
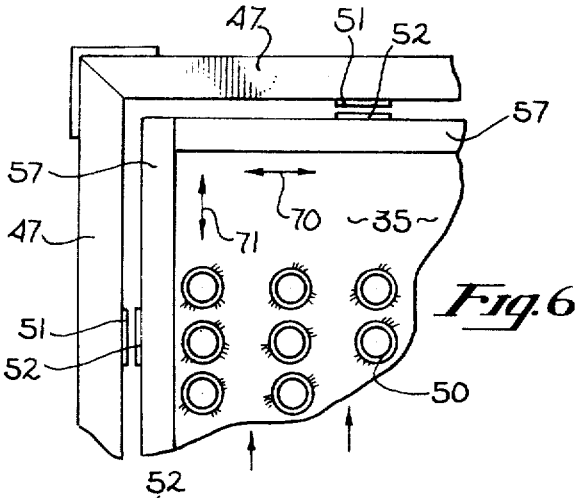
FIG. 6 is an exploded view of one corner of the inlet bulkhead of the heat exchanger taken through section line 6—6 of FIG. 3.
Figure 8:
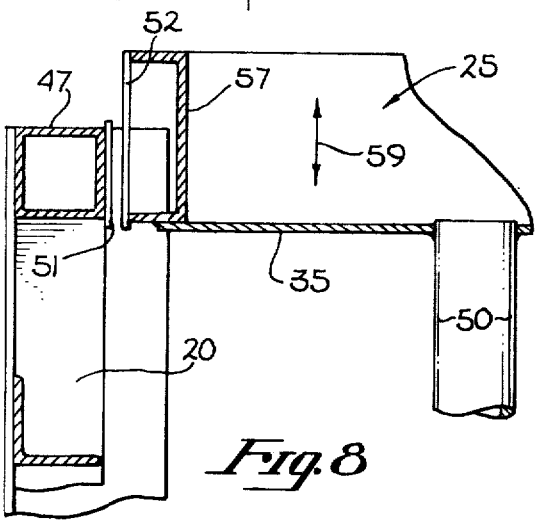
FIG. 8 is an exploded cross-sectional side view illustrating the upper end of the heat exchanger frame and the inlet bulkhead taken through section line 8—8 of FIG. 4.

The upper end of the frame 20 defines a generally rectangular (fixed) member 47 as seen in FIGS. 6, 8 and 9. Metal wear plates 51 are rigidly coupled to the interior of member 47 to facilitate movement of the bulkhead 52 relative to the frame 20.

Figure 11:
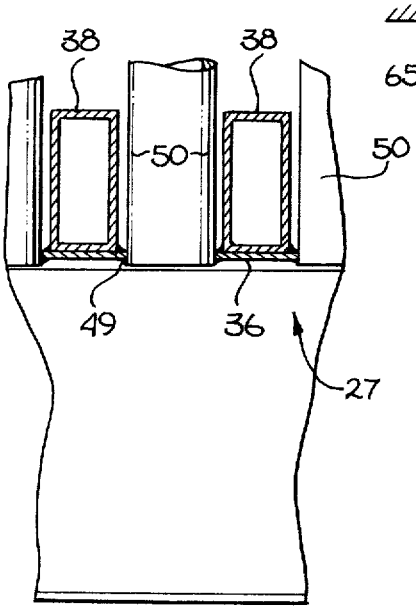
FIG. 11 is a partial cross-sectional front view of the center section of the support platform taken generally through section line 11—11 of FIG. 5.

The support platform 27 includes an outlet tube sheet 36. This sheet defines a plurality of apertures such as aperture 49 of FIG. 11 for receiving the lower ends of the tubes 50. The sheet 36 is stiffened by a plurality of beams 38 which are welded to the upper surface of the sheet 36. In fabrication after the apertures 49 have been drilled or cut through the plate or sheet 36, the beams 38 are welded in place. Then the tubes 50 are welded from the lower side of sheet 36. As is apparent the sheet 36 provides the vertical support for the tubes 50 and for the bulkhead 25 which bulkhead is carried on the upper ends of these tubes. The sheet 36 is welded to a channel 54 which supports the frame 20. the channel 54 is also coupled to the outlet transition member such that the cooled fluid from the tubes 50 may be directed from the heat exchanger.

The upper ends of the tube 50 as mentioned are coupled to the bulkhead 25. The lower portion of this bulkhead includes a tube sheet 35, which sheet may be similar to the sheet 36 of FIGS. 10 and 11. The tube sheet 35 as best illustrated in FIGS. 3, 6, 8 and 9, includes a plurality of apertures for receiving the upper ends of the tubes. In the presently preferred embodiment, the upper ends of the tubes are welded to the tube sheet 35. A channel 57 shown in FIGS. 8 and 9 is welded about the periphery of sheet 35; this channel forms a rectangular frame member which fits with the rectangular member 47 (FIG. 6). The flange ends of member 57 support a plurality of wear plates 52, which plates are secured to member 57 opposite the wear plates 51. In the presently preferred embodiment, the bulkhead 25 includes a plurality of replaceable tubes not illustrated in the drawings. These relatively short replaceable tubes direct the flow from the inlet transition member into the long tubes 50. The wear caused by the abrasive in directing the fluid flow from the transition members into the heat exchanger is substantially confined to these replaceable tubes. The bulkhead including the replaceable tubes is described in a copending application entitled "Replaceable Inlet Means for Heat Exchanger", Ser. No. 714,377, filed Aug. 16, 1976 and assigned to the assignee of the present application.

As is best illustrated in FIGS. 4, 5 and 7, a plurality of spacer sheets 43 are horizontally disposed within the frame 20 and secured to sheet support members 45 of the frame. The sheets 43 include a plurality of apertures such as aperture 48 shown in FIG. 7, which apertures are large enough to permit the tubes 50 to freely pass therethrough. The sheets 43 in addition to providing some rigidity to the frame 20 provide lateral support to the tubes 50 and assure that the tubes remain uniformly spaced within the heat exchanger, particularly when the tubes expand. It is apparent that the apertures of tube sheets 35 and 36 as well as the apertures of sheets 43 are in alignment such that the tubes 50 are maintained vertical.

As is seen from FIGS. 1 and 2, as the hot fluid enters the tubes from the transition members 18 and 19, the fluid is cooled by the cross flow 31, which flow is generated by the plurality of electrical fans 29. The hot fluid entering the tubes 50 as may be best envisioned from FIGS. 4 and 5 causes the tubes to expand particularly along their length, thereby causing the inlet bulkhead 25 to rise. As is indicated by arrow 59 of FIGS. 8 and 9 the bulkhead 25 is free to move within the member 47 of frame 20. Wear associated with this movement is confined to the wear plates 51 and 52. Expansion also occurs in the bulkhead in the directions indicated by arrows 70 and 71 of FIG. 6. Sufficient tolerance exists between the wear plates to accept this expansion.

Figure 12:
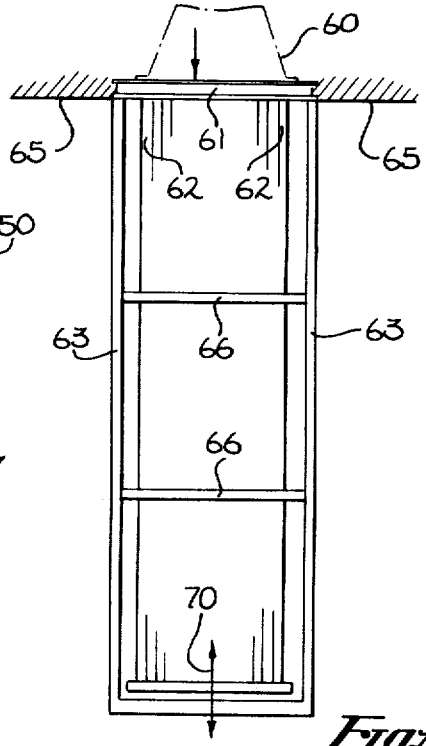
FIG. 12 illustrates an alternate embodiment of the heat exchanger where the upper end of the heat exchanger is securely mounted and where the lower ends of the elongated tubes are permitted to freely expand.

While in the presently preferred embodiment, the elongated tubes are supported at their lower (outlet) ends, the tubes may be supported at their upper ends with the lower ends free as is shown in the alternate embodiment of FIG. 12. In FIG. 12 an inlet (or outlet)

transition member 60 is coupled to the bulkhead 61. The bulkhead 61 is supported at support 65. The plurality of elongated tubes 62 hang from the bulkhead 61 within the frame 63. A plurality of spacer sheets 66 are again employed to provide lateral support to the tubes 62. The tubes 62 are allowed to freely expand along their lengths as indicated by arrow 70.

Thus, a heat exchanger has been described, which exchanger is particularly suitable for handling large volume of hot fluid. The heat exchanger may be employed where the hot fluid contains abrasives.

I claim:

1. A heat exchanger for receiving a hot inlet fluid from an inlet means and for providing cooler outlet fluid to an outlet means comprising:

a frame;

a plurality of generally parallel, vertical, elongated tubes for receiving said hot fluid, each of said tubes having an upper end and a lower end, said tubes disposed within said frame;

a support structure fixedly coupled to the lower end of said tubes and secured to said frame for providing vertical support to said tubes, said support structure coupled to said outlet means, said support structure includes a sheet having a plurality of apertures fixedly secured in alignment with said tubes and a plurality of beams for stiffening said sheet, said sheet having a first surface for securing said beams thereto, and a second surface for securing said tubes thereto;

an inlet bulkhead including a tube sheet secured thereto coupled between said inlet means and said upper ends of said tubes, said bulkhead floatingly mounted within said frame such that as said tubes expand said inlet bulkhead is permitted to move freely vertically; and means cooperating with said tubes for introducing fluid in heat exchange relationship with said hot inlet fluid.

2. The heat exchanger defined by claim 1 including at least one spacer sheet, said sheet including a plurality of apertures through which said tubes freely pass, said sheet being rigidly coupled to said frame.

3. The heat exchanger defined by claim 2 including wear plates disposed between said frame and said bulkhead to facilitate said vertical movement of said bulkhead.

* * * * *